US006454439B1

(12) United States Patent
Camarota

(10) Patent No.: US 6,454,439 B1
(45) Date of Patent: Sep. 24, 2002

(54) METHOD FOR MANUFACTURING A LIGHT ASSEMBLY FROM INTERCHANGEABLE COMPONENTS WITH DIFFERENT CHARACTERISTICS

(75) Inventor: Richard J. Camarota, Holland, MI (US)

(73) Assignee: ITC Incorporated, Holland, MI (US)

( * ) Notice: Subject to any disclaimer, the term of this patent is extended or adjusted under 35 U.S.C. 154(b) by 0 days.

(21) Appl. No.: 09/595,752

(22) Filed: Jun. 16, 2000

(51) Int. Cl.[7] ..... F21V 9/00

(52) U.S. Cl. ..... 362/293; 362/375; 362/433; 362/455; 362/546

(58) Field of Search ..... 362/293, 374, 362/375, 433, 455, 311, 326, 546

(56) References Cited

U.S. PATENT DOCUMENTS 5,239,449 A * 8/1993 Wnuk et al. ..... 362/490
5,377,087 A * 12/1994 Yoon ..... 362/275
5,560,707 A * 10/1996 Neer ..... 362/376
5,915,831 A * 6/1999 Bonin et al. ..... 362/519

OTHER PUBLICATIONS

ITC, Inc., Prizm™ Series Lighting, Product Brochure, 1 page, Jan., 2000.

* cited by examiner

*Primary Examiner*—Sandra O'Shea
*Assistant Examiner*—Ronald E. DelGizzi
(74) *Attorney, Agent, or Firm*—Flynn, Thiel, Boutell & Tanis, P.C.

(57) ABSTRACT

A light assembly (20) that includes a frame (28) and a body (22) disposed within the frame. A reflector (26), a socket (46) and a bulb (24) are disposed in the body. A lens (30) is fitted over the reflector, socket and bulb. The lens is snap fitted in a bezel ring (32). The bezel ring is snap fitted over to the body so as to be positioned around the reflector. The body is snap-fitted to the frame. An assembler of the light assembly of this invention can maintain a stock of frames, bodies and bezel rings that have different colors or other characteristics, such as on/off switches. Upon receiving an order for a light assembly in which the specific characteristics of the color are specified, the assembler selects the appropriate components from stock and assembles them together to provide the desired assembly.

22 Claims, 8 Drawing Sheets

METHOD FOR MANUFACTURING A LIGHT ASSEMBLY FROM INTERCHANGEABLE COMPONENTS WITH DIFFERENT CHARACTERISTICS

FIELD OF THE INVENTION

This invention relates generally to electrical light system such as a halogen light system. More particularly, this invention relates to a light system that can readily be assembled to form a number of versions of the system and to a halogen light system with a relatively cool outer frame.

BACKGROUND OF THE INVENTION

Electric lights are provided in locations in which natural light does not provide sufficient or appropriate illumination. Recently, it has become popular to provide lights with halogen bulbs. An advantage of a halogen bulb, in comparison to other bulbs, is that, for its size, it requires relatively little power to be energized and it radiates relatively large amounts of power. Often halogen light assemblies are mounted to pieces of furniture and display cases. When these lights are turned on, they provide relatively focused beams of light.

A light assembly, such as a halogen light assembly, can be considered to have both a body and a frame. The body supports a bulb socket and a reflector located around the socket. The frame serves as the housing in which the body is seated. Some light assemblies, such as halogen light assemblies, are also provided with a lens. The lens is seated over the bulb. The lens accomplishes two purposes. First, the lens focuses the light in a desired pattern. Secondly, the lens functions as a protect cover that prevents curious fingers from touching the bulb. When the bulb is on, radiating both light and heat, such contact can result in a painful and possibly damaging burn. Currently, it is often the practice to fabricate the body and frame of a light assembly together as a single, monolithic, unit. This assembly may also include a member that holds the lens to the frame.

The providers of light assemblies are increasing asked to provide different versions of their assemblies. One option the purchasers of these assemblies now like to have is the ability to obtain assemblies fabricated so that their exposed surfaces have different colors. For instance, a first purchaser may want an assembly in which the exposed surfaces have a common color. A second purchaser may request an assembly constructed so that its exposed surfaces adjacent the lens is a first color and the outer surface has a second color. Also, manufactures are often required to supplies different light assemblies that have different frames. Specifically, one purchaser may require a frame that designed for mounting to a surface so that the exposed surfaces are essentially flush with the adjacent support surface. A different purchaser may require a frame designed to project away from the adjacent surface to which the assembly is mounted. Some purchasers require that one/off switches be integrally mounted to the frames of their assemblies. Still other purchasers do not require and do not even want such switches.

Currently, in order for a manufacturer to meet the demand for all the different variations in types of assemblies, it must manufacture different numbers of assemblies. This often leaves the manufacturer with two choices. First, it can pre-manufacture a large number of different assemblies that vary in their features. Thus, the manufacturer will have available some assemblies that are all solid colors in the different colors in which it manufactures the assemblies. The manufacturer will also have available assemblies that have different, multi-color patterns. If the manufacturer markets versions of its light assembly that vary in the style of their frames, in order to be fully stocked, the number of different versions of pre-manufactured assemblies is then multiplied by the number of different available frames. Thus, in order for a manufacturer to be fully stocked, it must have available a large number of different light assemblies that differ by only several details in their color or other feature. Maintaining all these different light assemblies in inventory can easily become cost and stockeeping burdens.

The second choice available to the manufacturer is to fabricate specific assemblies as they are ordered. This "on request" manufacturing substantially eliminates the stockeeping burden associated with having different versions of an assembly pre-manufactured and ready for shipment. However, if the customer order is relatively small, it may not be economically worthwhile for a manufacturer to start up a production line in order to provide a few units that have a specific configuration. If this situation arises, the light assembly supplier is left with two choices. The supplier can commit to production recognizing that the output of the particular production run may not provide a-reasonable financial return. Alternatively, given the poor rate of return associated with the production run, the manufacturer can choose not to fulfill the customer's order. If this latter action is taken, the manufacture may also loose the repeat business the customer would have provided.

Even if the manufacturer agrees to provide the specific version of the light assembly, it may take some time for it to perform the required production run. A customer wanting the light assemblies may not appreciate or accept the delay associated with waiting to have them fabricated.

Also, there is a special problem that is often associated with halogen light assemblies. As a byproduct of the light it emits, a halogen bulb radiates an appreciable amount of thermal energy, heat. This thermal energy is absorbed by the surrounding components. In a single-piece light assembly, the heat is conductively transferred to the outer surface of the frame. Consequently, this surface becomes hot. Sometimes the temperature of this surface rises to the level at which should an individual contact it, he/she can potentially surfer a burn injury.

SUMMARY OF THE INVENTION

This invention relates to a new and improved light assembly. The light assembly of this invention is formed out of a number of different components. The components forming this assembly can readily be snap-fitted together. One advantage of the light assembly of this invention is that multiple versions of the same components are provided that have different surfaces and/or other different features. Thus, by selectively choosing the appropriate version of each component and mating the selected components together, an end product light assembly can be easily assembled that satisfies a particular customer's design characteristics.

Still another advantage of the light assembly of this invention is that the components forming the assembly inherently define at least one, if not more, air gaps between the bulb and the frame. These air gaps minimize the extent to which heat generated by the bulb, such as a halogen bulb, is transferred to the outer surface of the frame. The minimization of this thermal energy transfer reduces the extent the heat radiated by the bulb warms the outer surface of the frame.

BRIEF DESCRIPTION OF THE DRAWINGS

The invention is defined by the claims. The above and further advantages of the invention may be better understood by reference to the following drawings, in which:

DETAILED DESCRIPTION

Figure 1:
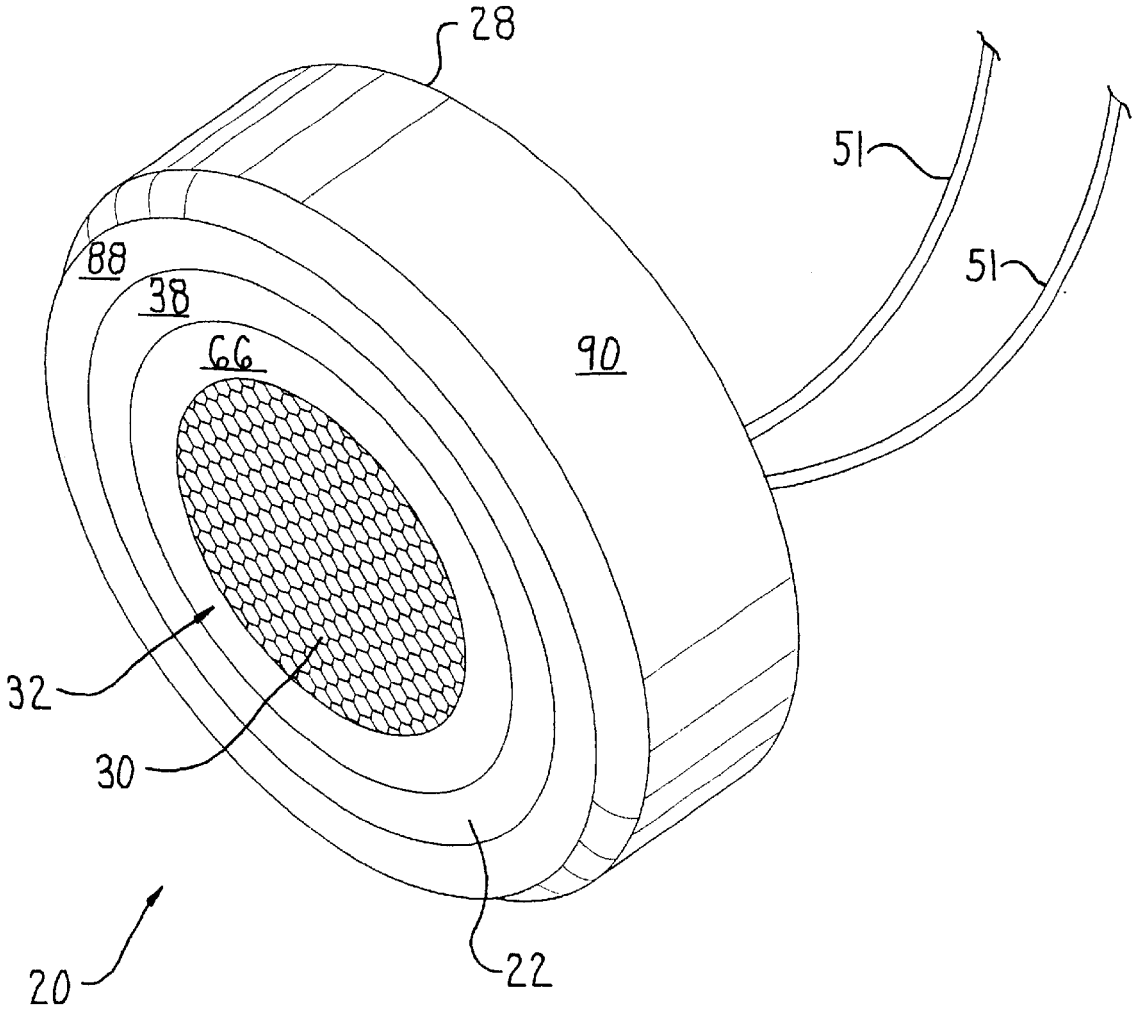
FIG. 1 is a perspective view of one particular version of the light assembly of this invention.
Figure 2:
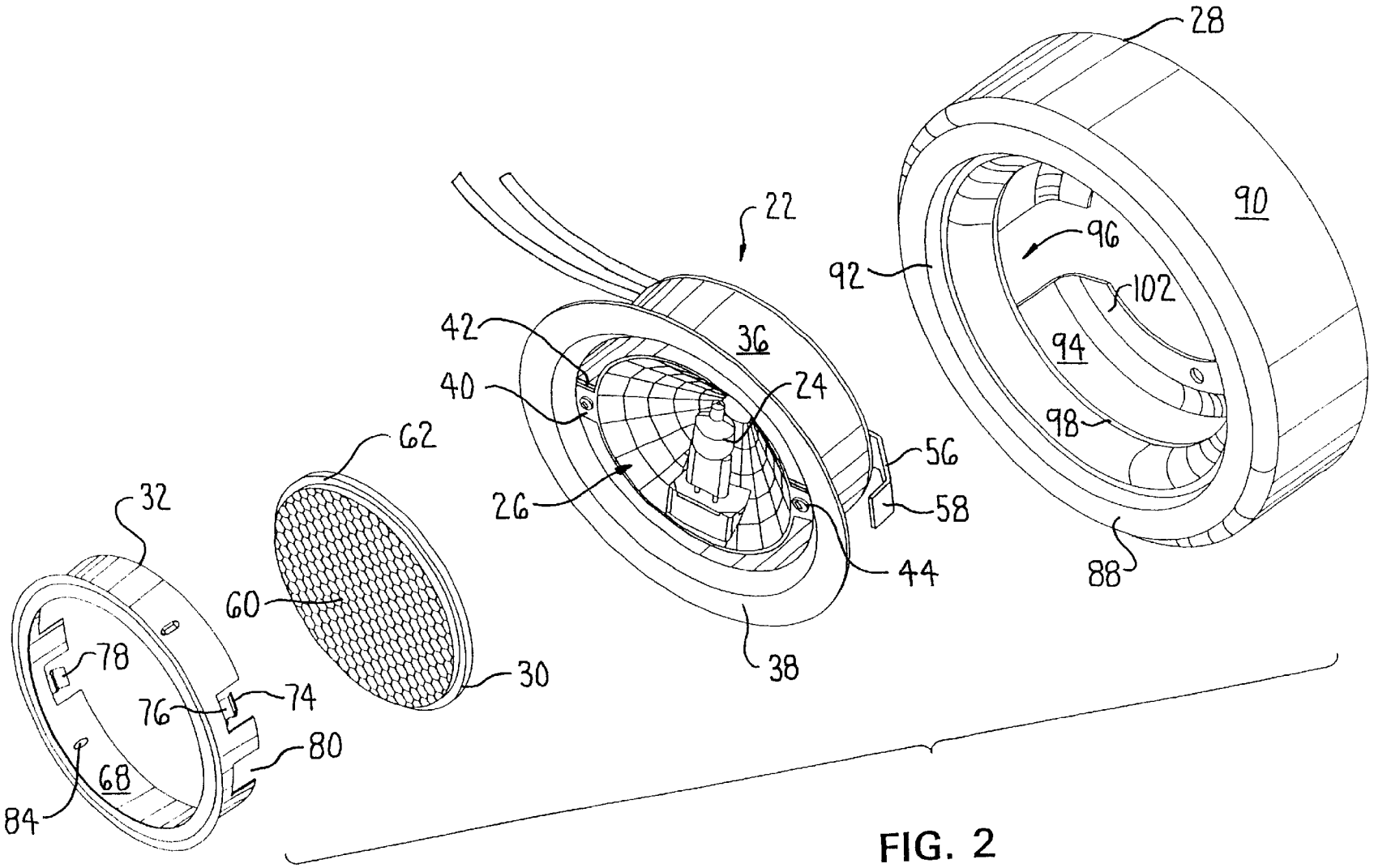
FIG. 2 is an exploded view of the components of the light assembly of FIG. 1.

FIGS. 1 and 2 illustrate a light assembly 20 of this invention and the components from which the light assembly is manufactured. Assembly 20 includes a body 22 to which a bulb 24 is mounted. In some preferred versions of the invention, bulb 24 is a halogen bulb. This type of bulb 24 provides relatively bright light when provided with a 12 Volt AC or DC signal. The body 22 has a reflector 26 which redirects the rearwardly-emitted light from the bulb 24 so that it is emitted outwardly from the from of the front of the assembly 20. Body 22 is seated in a frame 28. The depicted frame 28 is a surface-mount frame. This means the frame 28 is designed so that its rear surface rests on or is mounted to the surface on which the assembly 20 is placed. As discussed below, the light assembly 20 of this invention may be provided with other types of frames.

Light assembly 20 also includes a lens 30. Lens 30 is disposed over the bulb 24 and reflector 26. Lens 30 focuses the light emitted from bulb 25 in a desired pattern. The lens 30 also serves as a protective barrier that prevents inadvertent contact with the bulb 24. A bezel ring 32 holds the lens 20 over the body 22. The bezel ring 32 is snap-fitted into an annular space that surrounds the reflector 26.

Figure 3A:
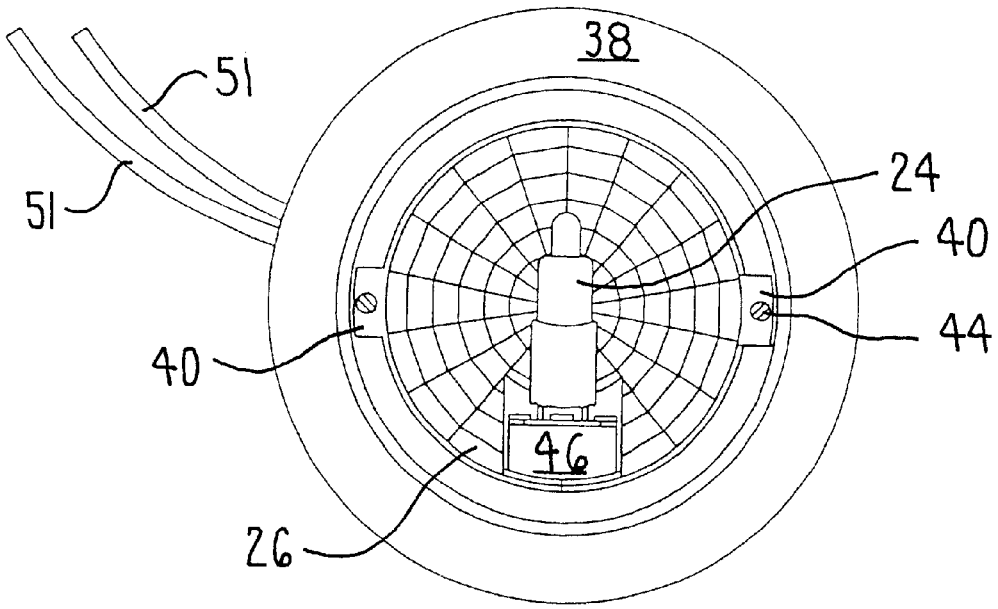
FIGS. 3A and 3B are, respectively, front and back views of the body of the light assembly.
Figure 3B:
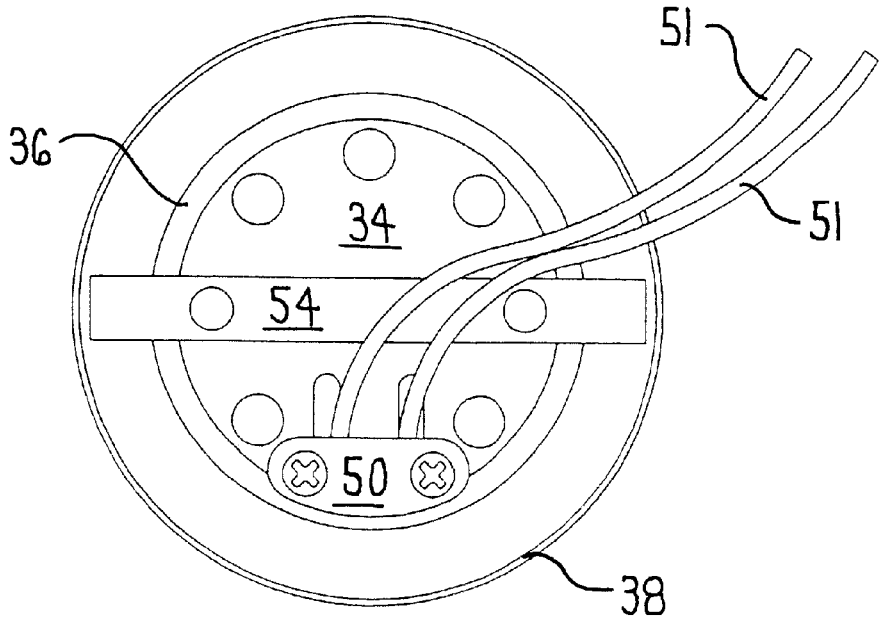

As seen from FIGS. 2, 3A and 3B, assembly body 22 is formed from a single piece of metal. Body 22 is shaped to have a circular base 34 and a tubular side wall 36 that extends upwardly from the body. A lip 38 extends perpendicularly outwardly from the circular top edge of side wall 36. The upper end of the side wall 36, the portion of the side wall immediately below the lip 38, is recessed slightly inwardly relative to the rest of the side wall. Body 22 is further formed so that outer end of the lip 38, the portion of the lip that forms the outer edge of the lip curves slightly downwardly relative to the inner portions of the lip.

Reflector 26 is located in the circular cross section space defined by body side wall 36. The reflector 26 has a shape that, geometrically, approximates an end slice section through the end surface of a sphere. Reflector 26 is formed out of material or its surface is coated so that its outwardly facing surface is reflective. The reflector 26, in addition to its above-described, partially spherically shaped main section has two outwardly-directed, rectangular shaped wings 40. The reflector wings 40 seat over tabs 42 that are formed by inwardly directed sections of the material that forms the body side wall 36. Threaded fasteners 44 secure the reflector wings 40 to the tabs 42 so as to secure the reflector 26 to the body 22.

A ceramic socket 46 is also located in the space enclosed by body side wall 36. The socket 46 has a front end that extends through an opening formed in the bottom of the reflector 26, (opening not identified). A backing plate 50 fitted over the rear surface of body base 34 and threaded fasteners 52 secure the socket to the body 22. The socket is formed with openings for receiving the bulb leads. Wires 51, which extend from the back of the body, serve as conductive members through energization current is supplied to the bulb 24 through the socket 46.

A strip of flexible metal 54 is secured to the rear surface of body base 34. Metal strip 54 is formed so that the opposed ends of the strip define opposed legs 56 that extend diagonally outwardly and forwardly from the body base 34. A foot 58, formed integrally with each leg 56, extends from the end of each leg. The feet 58 extend forwardly, toward the body lip 38.

Lens 30 is formed from silica glass and has a generally circular shape. The lens is further shaped to have a body 60 that has a raised, slightly convex profile. Integrally formed with the body 60, lens 30 has a lip 62 that extends around the outer perimeter of the body. Lip 62 has opposed upper and lower surfaces that are generally parallel to each other. The lens 30 is further formed so that the body 60 is slightly raised relative to the lip 62.

Figure 4A:
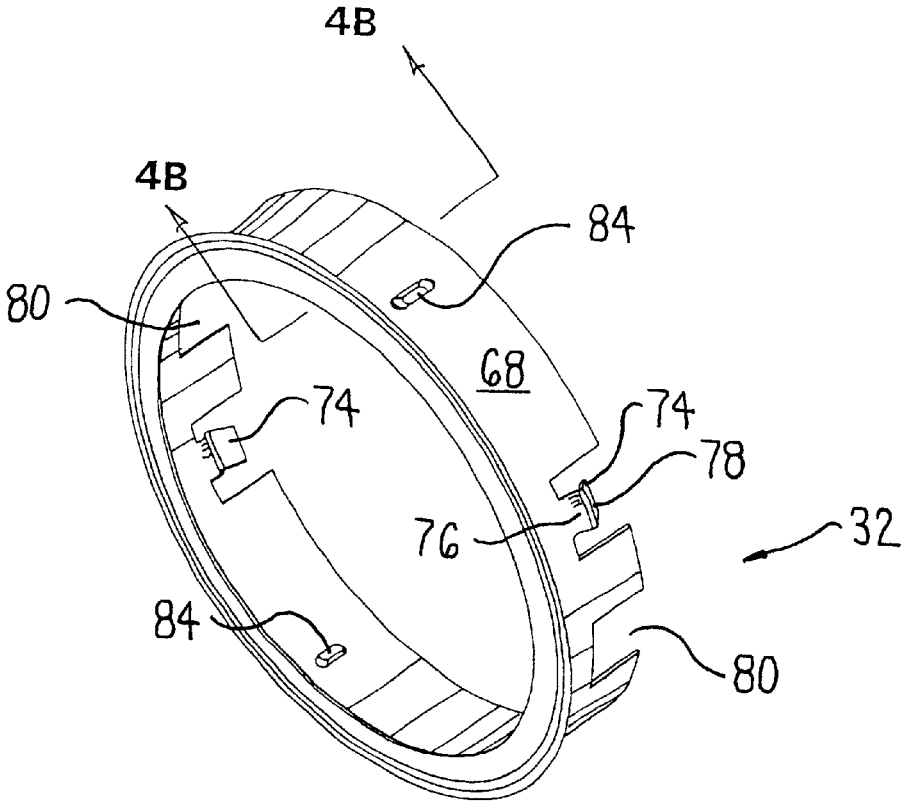
FIG. 4A is a perspective view of a bezel ring.
Figure 4B:
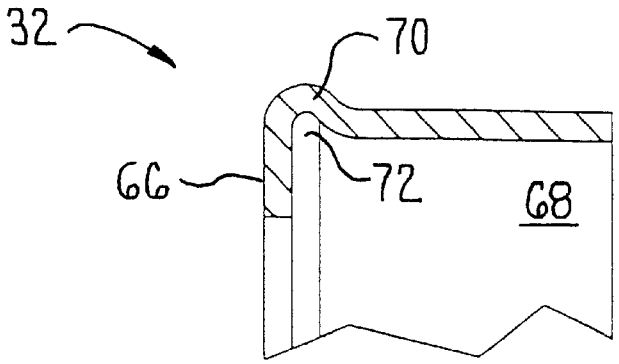
FIG. 4B is a partial cross sectional view of the bezel ring taken along line 4B—4B of FIG. 4A.

Bezel ring 32, now discussed with reference to FIGS. 4A and 4B, is formed out of a single piece of metal that generally has a circular shape. The bezel ring has a circular face 66. A multi-section circular side wall 68 extends downwardly from the face 66. More particularly, it will be observed that side wall 68 is located inwardly from the outer perimeter of bezel face 66. The bezel ring has a small, circularly shaped inwardly diagonally directed transition section 70 that extends from face 66 to side wall 68. It will be noted that the opposed surfaces of face 66 and transition section 70 are spaced apart from each other so as to form an interstitial gap 72 between these two structural members.

Bezel ring side wall 68 is shaped to define two diametrically opposed legs 74. Each leg 74 has an upper portion 76 that extends diagonally downwardly and outwardly from the adjacent portion of the transition section 70. Each leg 74 further has a lower portion 78, integral with the upper portion 76, that extends diagonally downwardly from the upper portion to which it is attached. It will be noted that side wall 68 is formed so that there is small gap, (not identified) between the sides of each leg and the adjacent edges of the arcuate sections of the side wall 68. Side wall 68 is further formed to define to additional diametrically opposed cut-out spaces 80. When the bezel ring 32 is fitted to the body 22, reflector wings 40 and body tabs 42 seat in spaces 80.

The bezel ring side wall 68 is further formed to define two diametrically opposed bosses 84. Each boss 84 is, relative to the adjacent portions of the side wall 68, a raised surface that extends inwardly towards the center of the bezel ring. Bosses 84 are located in the side wall 68 so as to be located immediately below the transition section 70. The distance between bosses 84 is less than the diameter of the lens 30. When the light assembly 20 is manufactured, the lens 30 is press fit into the annular interstitial gap 72 defined by the bezel ring 32. More particularly the lens lip 62 seats in gap 72. The bosses 84, which are located immediately below the lower surface of the lip 62, hold the lens 30 in position.

Figure 5A:
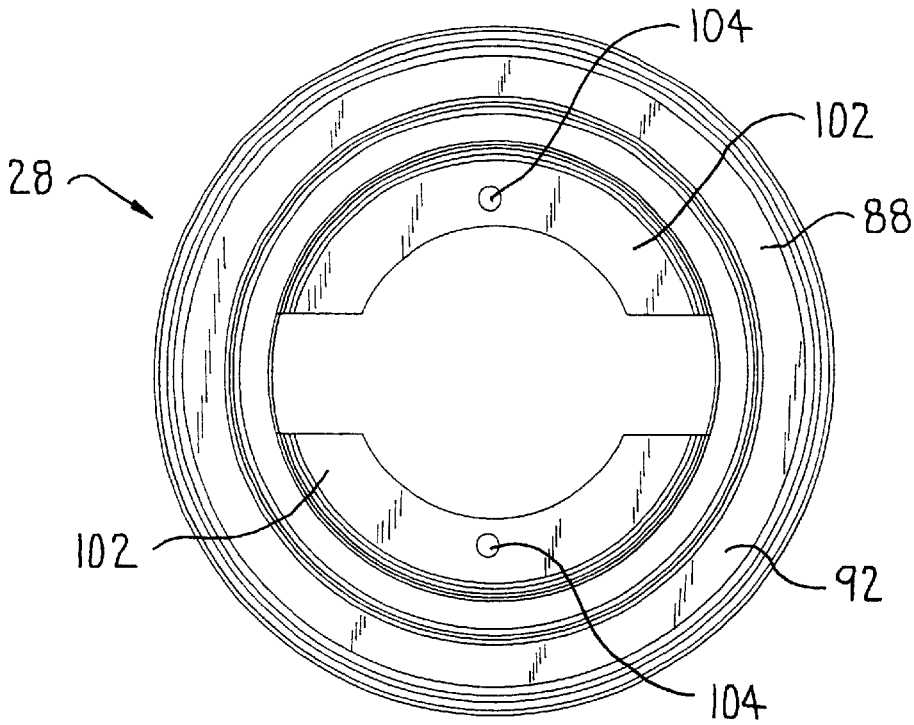
FIGS. 5A and 5B are, respectively, front and back views of one frame of the light assembly.
Figure 5B:
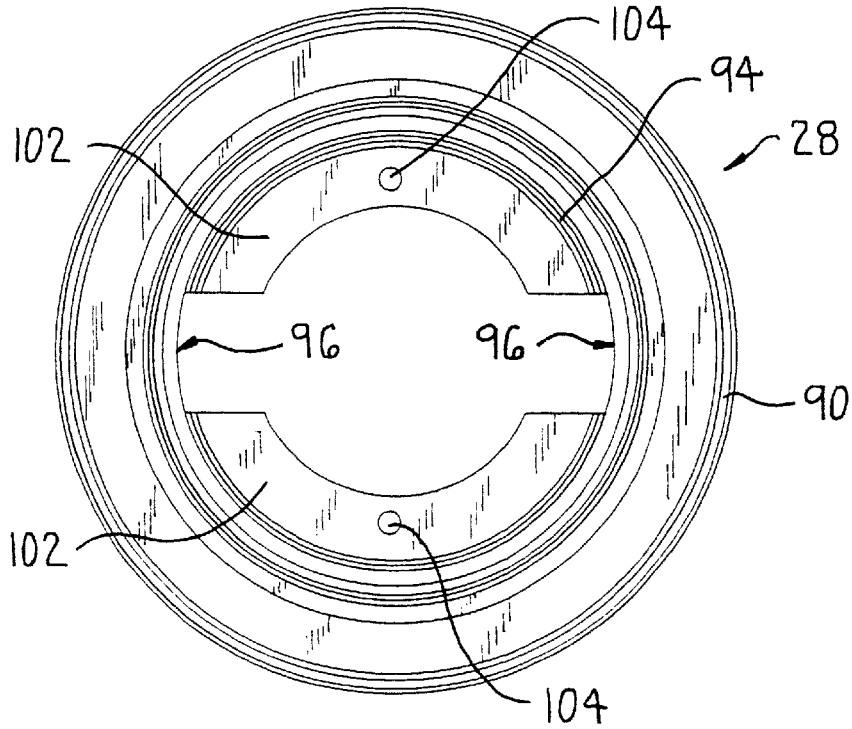

Light assembly frame 28, now described by reference to FIGS. 2, 5A and 5B, has a generally circular shape and is typically formed out of a single piece of metal or plastic. Frame 28 has a ring shaped, flat outer face 88. An outer wall 90 extends perpendicularly downwardly from the outer perimeter of face 88. The inner portion of face 88 is formed to have a recessed surface 92 relative to the outer portion of the face. A circular inner wall 94 extends perpendicularly downwardly from the inner perimeter of face 88. Inner wall 94 is shaped to define two, diametrically opposed cut-away spaces 96. The inner wall is further shaped to have a recessed annular groove 98 that extends around the perimeter of the wall a short distance below the top of the wall. More particularly, frame 28 is shaped so that groove 98 intersects the tops of the spaces 96.

Frame 28 is further formed to have two diametrically opposed tabs 102 that extend perpendicularly from the bottom end of the inner wall 94. More particularly, tabs 102 each have an arcuate shape and extend from a separate one of the sections of the inner wall 94. Each tab 102 is formed with an opening 104. The openings 104 accommodate fasteners, (not illustrated,) that are employed to secure the frame 28, and therefore the light assembly 20, to a surface.

Different versions of the body 22, the frame 28 and the bezel ring 32 of this invention are provided wherein the only difference between the individual versions of these components are their surface colors. Also, as discussed below, different types of frames 28 can be provided. Different versions of the lens 30 of this assembly 20 may also be provided. For instance, versions of the lens 30 may be shaped so they focus the light emitted by the bulbs 24 with which they are associated in different patterns. Also, different versions of the lens 30 may be dyed different so that each version only transmits a selected wavelength, (color,) of light.

Figure 6:
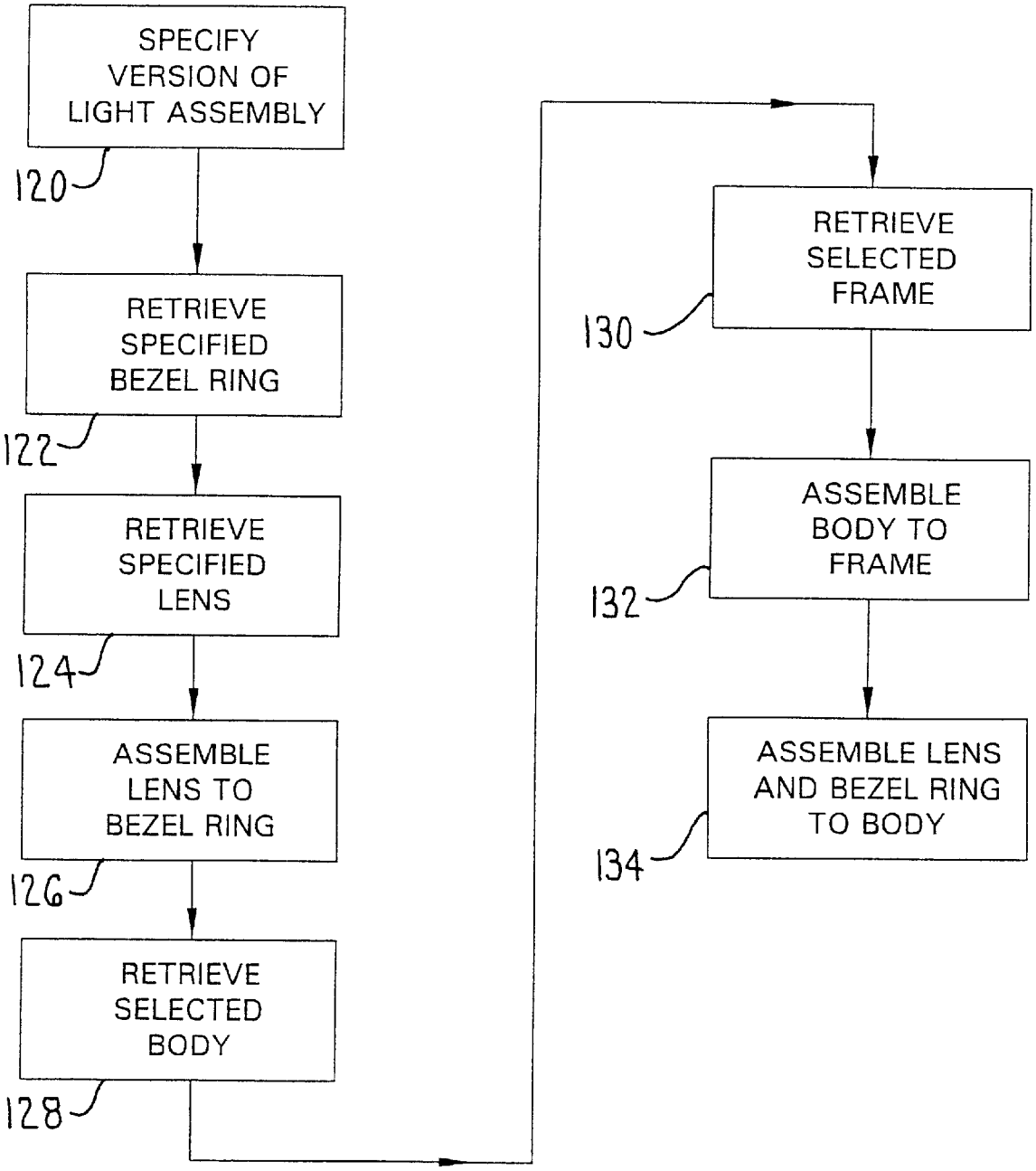
FIG. 6 is a flow chart depicting the part selection and part assembly processes employed to assembly a light assembly according to this invention.

FIG. 6 is a process chart depicting how a customer-specific version of the light assembly of this invention is assembled. As a precondition to this assembly process, the assembler maintains a stock of different versions of frames 28, bodies 22, lenses 30 and bezel rings 32. These versions of the frames 28, bodies 22 and bezel rings 32 differ in their color. The frames 28 will have other variations in type as discussed below. The versions of the lenses 30, differ in the characteristics of how they focus or light or allow light to pass through. In step 120, the customer specifies not just the type of frame 28 but also its color, and the color of the body 22. If lens choice is available, this is also specified by the customer. Then, as indicated by steps 122 and 124, based on the customer's selection specific color bezel ring and a specific type of lens are, respectively, retrieved from stock. Once steps 122 and 124 are performed, in step 126, the selected lens 30 is snap-fitted in the selected bezel ring 32.

In steps 128 and 130, a body 22 and a frame 28, based on the customer's selections, are, respectively, retrieved from stock. Once the body 22 and frame 28 are retrieved, in step 132, these components are assembled together. More particularly, the body 22 is pressed into the space enclosed by the frame inner wall 94. The joints between the legs 56 and feet 58 integral with metal strip 54 snap fit into groove 98 of the frame 28. The seating of these portions of the metal strip 54 into the groove serves to hold the body 22 to the frame 28. When the body 22 is so secured, body lip 62 seats in the annular space immediately above the recessed surface 92 of frame face 88.

Once the body 22 and frame 28 are assembled together, in step 134 lens 30 and bezel ring 32 are attached to the partially fabricated assembly 20.

Specifically, the bezel ring side wall 68 and legs 74 are seated in the annular space between the main section of the reflector 26 and the body base side wall 36. As a result of the pressing of the bezel ring 32 against the body 22, the upper portions 76 of the legs 74 of the bezel ring seat against the inwardly recessed portion of the body base side wall 36. This seating of the legs 74 secures the lens 30 and bezel ring 32 to the rest of the assembly 20.

An advantage of the assembly 20 and the method of manufacture of this invention is that the assembler can readily provide different versions of the assembly, in different colors, in a relatively short amount of time. This means that the manufacturer, or other assembler, does not have to keep in stock a number of different, fully-manufactured light assemblies that only have variations in the colors of their exposed surfaces. Moreover, since different frames 28 are available, the assembler likewise does not have to maintain a stock of different light assemblies that vary only by frame type.

Moreover, the body 22, the frame 28, the lens 30 and Liz the bezel plate 32 of the light assembly 20 of this invention all snap fit together. Neither supplemental fastening components nor fastening tools are required to assemble these components so that they form a light assembly 20. An advantage of this feature of the invention is that it serves to reduce both the time and skill level required to hold the light assembly 20 together.

The light assembly 20 of this invention is further arranged so that the reflector 26 is substantially suspended in the body 22. Also, only the edge of the body lip 38 and the metal strip of the base physically contact the frame. Collectively, an advantage of this arrangement is that there is minimal physical contact between the portions of the body 22 that are heated by the bulb 24 and the frame 28. Moreover, there is air flow around the body 22. This airflow convectively transfers the heat emitted by the bulb away from the light assembly. Collectively, these features reduce the extent to which thermal energy is conducted to the frame.

The reduction in this energy transfer reduces the extent to which the outer surface of the frame is heated by the actuation the bulb. The reduction of this energy transfer minimizes the possibility that an individual touching the frame 28 while the bulb is active may burn his/her fingers.

Figure 7:
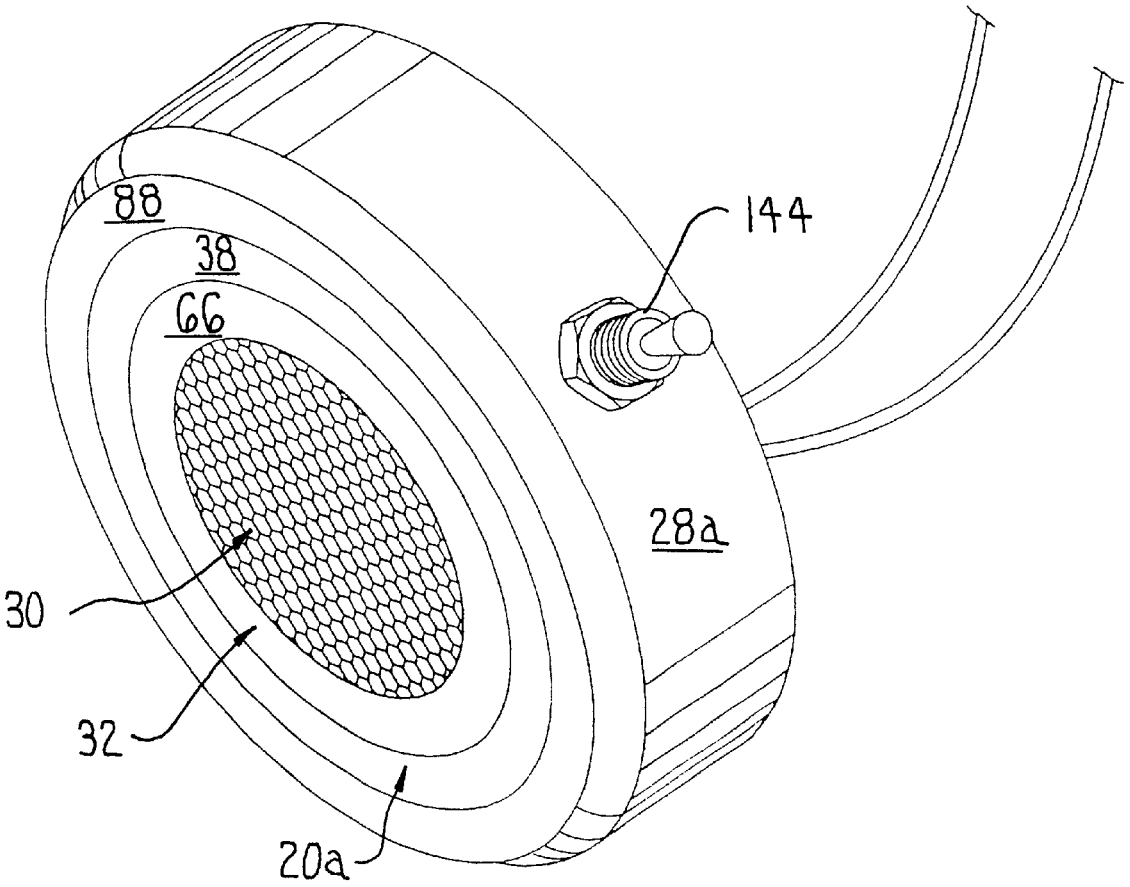
FIG. 7 is a perspective view of a light assembly of this invention with a first alternative frame.

FIG. 7 illustrates a light assembly 20*a* of this invention with an alternative frame 28*a*. Frame 28*a* includes the same basic structural features as previously described frame 28. Frame 28*a* also includes a switch 144. The switch 144 is mounted to the inner surface of outer wall 90. The switch 144 is actuated to open/close the connection to the bulb 24 in order to control the on/off state of the light assembly 20. Assembly 20*a* includes the previously described body 22, lens 30 and bezel ring 32.

Figure 8B:
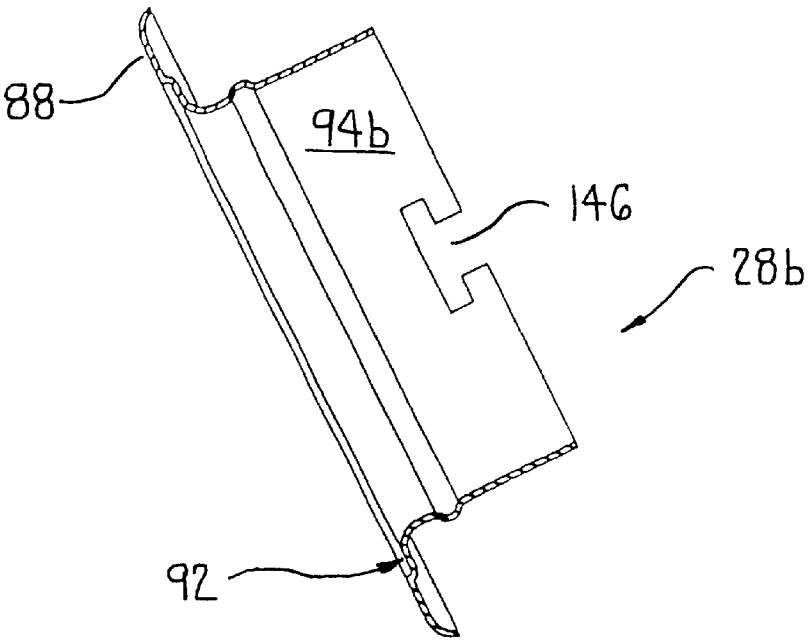
FIG. 8B is a cross-sectional view of the second alternative frame taken along line 8B—8B of FIG. 8A.
Figure 8A:
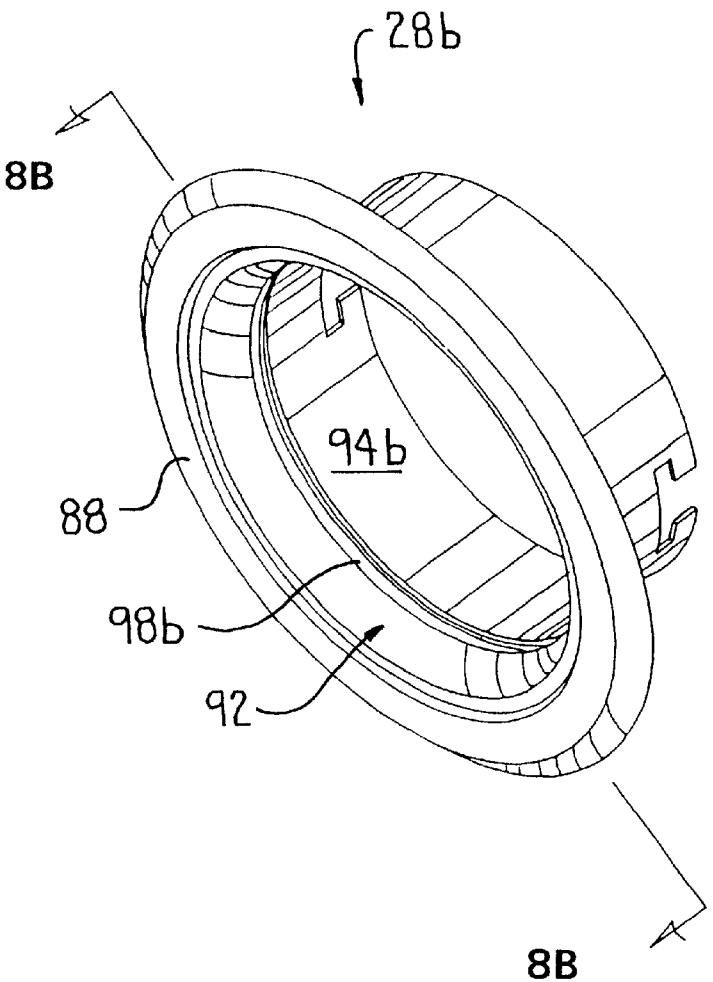
FIG. 8A is a perspective view of a second alternative frame.

Another alternative frame, frame 28*b*, of this invention is illustrated by FIGS. 8A and 8B. Frame 28*b* has the same basic face 88 of frame 28. Frame 28*b* does not have an outer wall. Frame 28*b* has an inner wall 94*b*. Inner wall 94*b* is shaped to define a groove 98*b*. Inner wall 94*b* is further formed to define two, diametrically opposed T-shaped openings 146 that extend upwardly from the bottom edge of the wall. Openings 146 do not extend to the height of the groove 98*b*.

Frame 28*b* is designed to be mounted in an opening formed in a complementary support surface such as a ceiling or side panel. Once the light assembly with frame 28*b* is so mounted, wing plates, (not illustrated) are fitted in openings 146. The wing plates are provided with fasteners that hold the light assembly in or to the complementary support surface.

It is a feature of the method of manufacture of this invention that the assembler's stock include not only frames of different color, but also different types of frames. In step 120, the customer selects both the type and color of the frame. Then, in step 130, the correct type and color of frame is retrieved based on the customer's selection. If the light assembly 20 is to provided with frame 28*a*, in step 132, an electrical connection is made between the socket 46 and switch 144.

It should be recognized that the foregoing description is limited to a few specific versions of the light assembly 20 of this invention and its method of manufacture. Other versions of this invention may vary from what has been described. For example, the disclosed body includes a halogen light bulb. In other light assemblies of this invention, the body may be fitted with other types of light bulbs such as conventional incandescent bulbs, zenon bulbs or an array of one or more LEDs. The surface colors of the components of the light assembly can vary from what has been described.

Also, it should be understood that the body 22, frame 28 and bezel ring 32 of the light assembly 20 of this invention may be formed from different types of materials. In some versions of the invention, these components are formed from metal. Some possible metals from which these components may be formed include brass, aluminum or stainless steel. In still other versions of the invention, the body 22, frame 28 and bezel ring 32 are formed from plastic.

Moreover, in some versions of the invention it is desirable to fit a gasket around the lip 62 of the lens 30. When the lens 30 is fitted to the bezel ring 32, this gasket forms a water-tight barrier between the lens 30 and the bezel ring 32. In this version of the invention, a rubber disk or other component that provides a water barrier is secured to the base 34 of the body 22. Also, in this version of the invention a compressible washer is fitted around the rearwardly directed outer surface of the bezel ring transition section 70. When the bezel ring 32 is secured to the body 22, this washer provides a liquid-tight barrier around the interface of these two components. Collectively, the gasket around the lens 30, the base disk and the washer prevent liquid from penetrating into the base 22. Thus, this version of the invention is a water tight light assembly 20 that is suited for some marine applications and other environments in which the assembly may occasionally exposed to water or other liquids.

Also, for some applications, the light assembly of this invention may only consist of a body 22, a lens 30 and a bezel 30. This light assembly would not have a frame. This version of the invention can serve as a recessed light assembly. In this version of the invention, the customer may only have two color choices; the bezel and the exposed surface of the body 22. In the assembly of this version of the invention, steps 130 and 132 are not performed.

Also, alternative constructions of the components are possible. For example, in some alternative versions of the invention, the on/off switch for the light may be mounted to the base lip 38.

Therefore, it is an object of the appended claims to cover all such modifications and variations that come within the true spirit and scope of this invention.

What is claimed is:

1. A method of manufacturing a light assembly, said method including the steps of:

providing a plurality of frames, each frame having an exposed circumferential outer face that defines an opening, wherein at least two of the frames have outer faces that have different colors;

providing a plurality of body units, each body unit including:

a base and an exposed lip that circumferentially surrounds the base, the lip forming an exposed surface of the body unit wherein, at least two of the provided body units have lips that have different colors; and a reflector, socket and bulb assembly that is mounted in the base, wherein the reflector, socket and bulb assembly is inwardly spaced relative to the lip;

providing a plurality of bezels wherein, at least two of the bezels are of different color;

selecting a specific frame for assembly based on the selected frame having an outer face with a customer-desired color;

selecting a specific body unit for assembly based on the selected body unit lip having a customer-desired color;

selecting a specific bezel for assembly based on the selected bezel having a customer-desired color;

retrieving the selected frame;

retrieving the selected body unit;

retrieving the selected bezel;

placing a lens over the reflector, socket and bulb assembly of the selected body unit;

fitting the retrieved bezel around the lens and securing the retrieved bezel to the retrieved body unit so that the bezel seats in an interstitial space between the bezel lip and the reflector, socket and bulb assembly wherein, the bezel holds the lens to the body unit; and securing the retrieved body unit in the retrieved frame.

2. The method of manufacture of claim 1, wherein:

the provided frames have different shapes; and said step of selecting a frame is further made by selecting a frame based on the shape of the frame.

3. The method of manufacture of claim 1, wherein:

at least one of the provided frames has an on/off switch and at least one of the provided frames does not have an on/off switch; and said step of selecting a frame is further made by selecting a frame based on whether or not the frame has an on/off switch.

4. The method of manufacture of claim 1, wherein the lens is secured to the retrieved bezel prior to said step of securing the retrieved bezel to the retrieved body unit.

5. The method of manufacture of claim 1, wherein:

when the lens is fitted to the retrieved bezel, the lens is secured to the bezel without supplemental fastening members separate from the bezel or the lens;

in said step of securing the retrieved bezel to the retrieved body unit, the bezel is secured to the body unit without supplemental fastening members separate from the body unit or the bezel; and in said step of securing the retrieved body unit to the retrieved frame, the body unit is secured to the frame without supplemental fastening members separate from the frame or the body unit.

6. The method of manufacture of claim 5, wherein:

the bezels are provided with a plurality of outwardly directed legs; and in said step of securing the retrieved bezel to the retrieved body unit, the legs of the bezel engage complementary surfaces of the body unit base.

7. The method of manufacture of claim 5, wherein:

the body units are provided with a plurality of flexible legs that extend outward from the base; and in said step of securing the retrieved body unit to the retrieved frame, the legs of the body unit engage complementary surfaces of the frame.

8. The method of manufacture of claim 1, wherein:

the bezels are provided with a plurality of outwardly directed legs; and in said step of securing the retrieved bezel to the retrieved body unit, the legs of the bezel engage complementary surfaces of the body unit base.

9. The method of manufacture of claim 1, wherein:

the body units are provided with a plurality of flexible legs that extend outward from the base; and in said step of securing the retrieved body unit to the retrieved frame, the legs of the body unit engage complementary surfaces of the frame.

10. The method of manufacture of claim 1, wherein:

at least one of the provided frames is shaped for surface mounting and at least one of the provided frames is not shaped for surface mounting; and said step of selecting a frame is further made by selecting a frame based on whether or not the frame is shaped for surface mounting.

11. The method of manufacture of claim 1, further including the steps of:

providing a plurality of lenses, at least two of the lenses have different characteristics; and retrieving a selected one of the provided lenses for use in said step of placement over the reflector, wherein the retrieved lens is selected based on the lens having a customer-desired characteristic.

12. A method of assembling a light assembly, said method including the steps of:

providing:

a plurality of frames, each frame having an exposed face that defines an opening, wherein at least two of the frames have exposed faces that have different colors;

a plurality of body units, each body unit having a base with a circumferential lip and a socket, bulb and reflector assembly disposed in the base wherein, at least two of the body units have body unit lips that have different colors; and a plurality of bezels wherein, at least two of the bezels have different colors;

retrieving one of the frames based on the color of the exposed face of the frame;

retrieving one of the body units based on the color of the lip of the body unit;

retrieving one of the bezels based on the color of the bezel;

securing a lens to the retrieved bezel;

attaching the retrieved bezel to the retrieved body unit so that the lens covers the socket, bulb and frame assembly and the bezel is located within a space at least partially defined by the lip of the body unit; and attaching the retrieved body unit to the retrieved frame so that the body unit is secured in the opening of the frame.

13. The method of assembly of claim 12, wherein:

in said step of securing the lens to the retrieved bezel, the lens is secured to the bezel without supplemental fastening members separate from the bezel or the lens;

in said step of attaching the retrieved bezel to the retrieved body unit, the bezel is secured to the body unit without supplemental fastening members separate from the body unit or the bezel; and in said step of attaching the retrieved body unit to the retrieved frame, the body unit is secured to the frame without supplemental fastening members separate from the frame or the body unit.

14. The method of assembly of claim 13, wherein:

each bezel is provided with a plurality of outwardly directed legs; and in said step of attaching the retrieved bezel to the retrieved body unit, the legs of the bezel engage complementary surfaces of the body unit base.

15. The method of assembly of claim 13, wherein:

each body unit is provided with a plurality of flexible legs that extend outward from the base; and in said step of attaching the retrieved body unit to the retrieved frame, the legs of the body unit engage complementary surfaces of the frame.

16. The method of assembly of claim 12, wherein:

at least two of the frames have different shapes; and said step of retrieving one of the frames is further made based on the shape of the retrieved frame.

17. The method of assembly of claim 12, wherein:

a plurality of the frames that are provided have on/off switches and a plurality of the frames that are provided do not have an on/off switches; and said step of retrieving one of the frames is further made based on whether or not the retrieved frame has an on/off switch.

18. The method of assembly of claim 12, wherein:

each bezel is providing with a plurality of outwardly directed legs; and in said step of attaching the retrieved bezel to the retrieved body unit, the legs of the bezel engage complementary surfaces of the body unit base.

19. The method of assembly of claim 12, wherein:

each body unit is provided with a plurality of flexible legs that extend outward from the base; and in said step of attaching the retrieved body unit to the retrieved frame, the legs of the body unit engage complementary surfaces of the frame.

20. The method of assembly of claim 12, wherein the lens is secured to the retrieved bezel prior to said step of attaching the retrieved bezel to the retrieved body unit.

21. The method of assembly of claim 12, wherein:

the different characteristics of the frames further include that at least one frame is shaped for surface mounting and at least one frame is not shaped for surface mounting; and said step of retrieving a frame is further made by retrieving a frame based on whether or not the frame is shaped for surface mounting.

22. The method of assembly of claim 12, further including the steps of:

providing a plurality of lenses, at least two of the lenses have different characteristics; and retrieving a selected one of the lenses for use in said step of securing a lens to the retrieved bezel, wherein the retrieved lens is selected from the plurality of lenses based on the lens having a customer-desired characteristic.

* * * * *